US005184828A

United States Patent [19]

Kim et al.

[11] Patent Number: 5,184,828

[45] Date of Patent: Feb. 9, 1993

[54] SOLID THREE-PIECE GOLF BALL

[75] Inventors: Moon K. Kim; In H. Hwang, both of Seoul, Rep. of Korea

[73] Assignee: Ilya Co. Ltd., Seoul, Rep. of Korea

[21] Appl. No.: 699,933

[22] Filed: May 14, 1991

[30] Foreign Application Priority Data

Jun. 1, 1990 [KR] Rep. of Korea ..... 90-8095

[51] Int. Cl.[5] ..... A63B 37/06

[52] U.S. Cl. ..... 273/228; 273/230

[58] Field of Search ..... 273/220, 230, 62, 228, 273/218, 219, 225, 229

[56] References Cited

U.S. PATENT DOCUMENTS 4,570,937 2/1986 Yamata ..... 273/220
4,650,193 3/1987 Molitor et al. ..... 273/230 X
4,714,253 12/1987 Nakahara et al. ..... 273/230 X
4,781,383 11/1988 Kamata et al. ..... 273/230 X
5,002,281 3/1991 Nakahara et al. ..... 273/230 X
5,048,838 9/1991 Chikaraishi et al. ..... 273/230 X

*Primary Examiner*—George J. Marlo
*Attorney, Agent, or Firm*—Amster, Rothstein & Ebenstein

[57] ABSTRACT

A non-wound three-piece golf ball which comprises an inner core, an outer layer and a cover, the inner core having a diameter of 23–35 mm and a hardness (Shore D) of 30–62, the outer layer having a diameter of 36–41 mm and a hardness (Shore D) of 30–56, the golf ball having a hardness (Shore D) 46–62 at the outer site in the inner core, which is 11.5–17.5 mm apart from the center of the ball. The golf ball has a maximum hardness (Shore D) in the range of 46–62 at the outer site of the inner core which is located at the interface between the inner core 1 and the outer layer 2 of the golf ball and the hardness then decreases both inwardly and outwardly.

5 Claims, 2 Drawing Sheets

FIG. 1
FROM CENTER
11.5 - 17.5 m/m apart
SHORE D
46-62
CENTER A. SHORE D 30-48
5 m/m apart B. SHORE D 40-35
10 m/m apart C. SHORE D 43-58
14 m/m apart D. SHORE D 46-62
18 m/m apart E. SHORE D 30-56
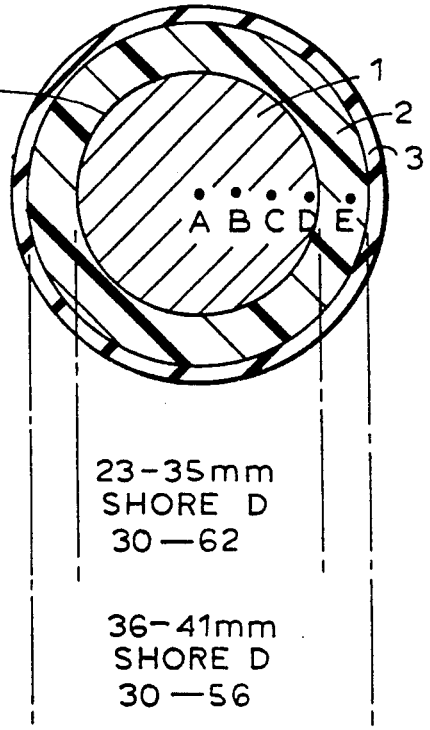
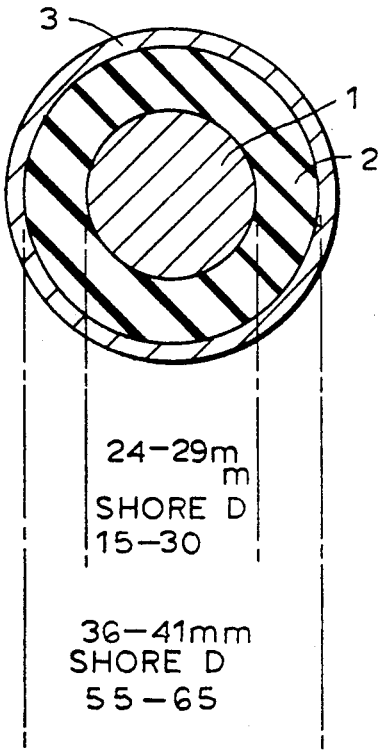
FIG. 4
PRIOR ART

SOLID THREE-PIECE GOLF BALL

The present invention relates to a solid three-piece golf ball having improved rebound characteristics and carry distance while maintaining adequate spin performance. These properties are obtainable by controlling the size of the inner core and outer layer as well as the specific gravity and hardness.

The carry distance and spin performance of a golf ball are very important for the game. Although a solid two-piece ball generally has good rebound characteristics and carry distance, the core is too hard to provide a good spin performance. On the other hand, while a thread wound golf ball generally has a good spin performance, the rebound characteristics and carry distance deteriorate as the wound thread is loosened by prolonged use of the ball.

U.S. Pat. No. 4,781,383 discloses a solid three-piece ball as shown in FIG. 4, which was obtained by controlling the size and hardness of the inner core and the outer layer. This ball has a carry distance similar to that achieved by a solid two-piece ball and feels similar to a conventional thread wound ball. However, this ball has a soft inner core and a hard outer layer. Therefore, it cannot provide a satisfactory carry distance and spin performance.

The total distance achieved by a golf ball includes the carry distance and the run distance. However, the carry distance is very important since the run distance is not accurate due to the unevenness of the ground. The carry distance of a golf ball is directly influenced by its rebound characteristics. Under identical rebound characteristics and aerodynamic conditions (dimple characteristics of the ball), the lifting ability of a ball is improved if the spin rate is increased. Therefore, the peak of the trajectory gets higher, thereby providing an increase in carry distance, as the spin rate increases until the spin rate is increased up to about 2500–3000 RPM, when the ball is struck by a driver.

The present invention provides a solid three-piece golf ball having superior rebound characteristics and carry distance, while maintaining adequate spin rate. These effects are achieved by controlling the sizes, specific gravity and hardness of each part of the solid three-piece golf ball.

In accordance with the present invention there is provided a solid three-piece golf ball comprising a core assembly provided by an inner core 1 and an outer layer 2 and a cover 3 characterized by the following features:

a) the inner core 1 has a diameter in the range 23–35 mm and hardness (Shore D) in the range 30–62;

b) the outer layer 2 has a diameter in the range 36–41 mm and hardness (Shore D) in the range 30–56;

c) the golf ball has a maximum hardness (Shore D) in the range of 46–62 at the outer site of the inner core which is located at the interface between the inner core 1 and the outer layer 2 of the golf ball and the hardness then decreases towards both sides.

Referring to the drawings:

FIG. 1 is a sectional view of a solid three-piece golf ball in accordance with the present invention.

Figure 2:
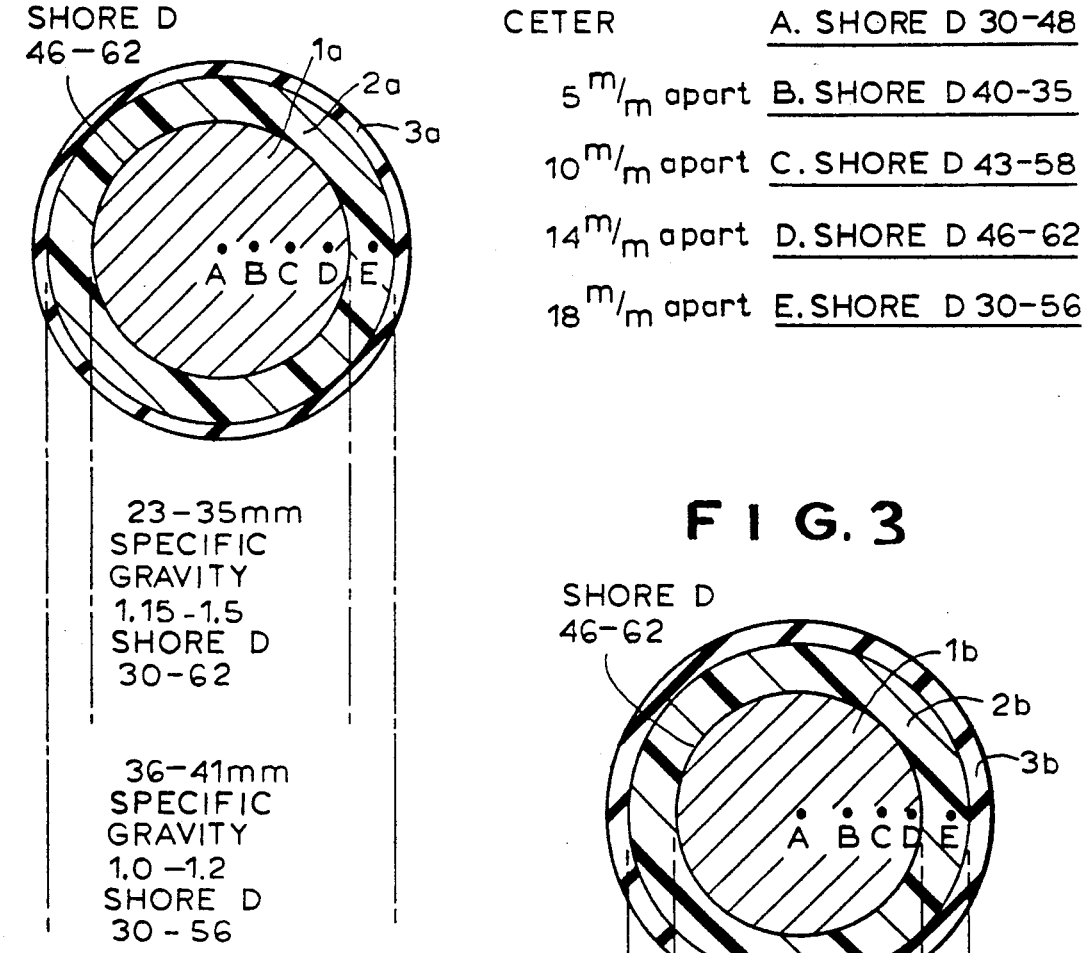
FIG. 2 is a sectional view of a first embodiment (type 1) of the golf ball according to the present invention.

FIG. 4 is a sectional view of the solid three-piece golf ball according to the U.S. Pat. No. 4,781,383.

As shown in FIG. 1, the solid three-piece ball according to the present invention comprises an inner core (1), an outer layer (2) covering the inner core and a cover (3) for protecting the outer layer.

If the surface of the inner core of the solid two-piece ball is soft, the difference between the moduli of elasticity of the inner core and the cover is increased. This generally tends to cause a reduction of rebound coefficient of the ball.

However, it has been found that the rebound characteristics of a solid three-piece golf ball can be improved by controlling the hardness distribution in the outer layer and the inner core in such a way that the golf ball has a maximum hardness at the outer site in the inner core as shown in FIG. 1, which is located at the interface between the inner core and the outer layer of the golf ball, and then the hardness decreases from that site both towards the outer surface of the outer layer and towards the center of the inner core. It has also been found that such a distribution of hardness in the core assembly allows a high energy to accumulate at the interface region where the hardness is maximum. Therefore, when the solid three-piece golf ball according to the present invention is struck by the club, the energy of the club face is efficiently delivered to the maximum hardness region and transferred toward the inner core without loss thus resulting in a high rebound coefficient. It has been observed that the fluctuation of hardness (Shore D) within 2, however, does not adversely affect the efficient transfer of the energy or spin performance of the golf ball of the present invention.

It has been found that the golf ball according to the present invention has adequate spin performance to provide an optimum trajectory resulting in an increase of carry distance since the outer layer is softer than the inner core. Furthermore, the golf ball of the present invention advantageously provides a delayed departure of the golf ball during the putting.

The diameter of the inner core of the golf ball according to the present invention is set to 23–35 mm. If the diameter of the inner core is less than 23 mm, the diameter of the soft outer layer has to be increased and rebound characteristics are adversely affected. On the other hand, if the diameter of the inner core exceeds 35 mm, the diameter of the outer layer has to be decreased, and feeling would be adversely affected due to the hard inner core.

The hardness (Shore D) of the inner core is preferably set in the range of 30–62. A inner core having a hardness (Shore D) less than 30 is too soft to give rebound characteristics necessary for reaching near the initial velocity limitation 250 ft/sec (+2% tolerance) required by U.S.G.A. and R. & A. If the hardness (Shore D) exceeds 62, the feeling of the ball is adversely affected.

The diameter of the outer layer is set to 36–41 mm. If it is less than 36 mm, the carry distance will be decreased due to the increased thickness of the cover. On the other hand, if the diameter of the outer layer is greater than 41 mm, the thickness of the cover will have to be decreased thereby adversely affecting the durability of the ball.

The hardness (Shore D) of the outer layer is set to 30–56 since if the outer layer has a hardness (Shore D) less than 30 it is too soft to provide the rebound characteristics necessary for reaching near the initial velocity 250 ft/sec (+2% tolerance). If the hardness (Shore D) exceeds 56, it is difficult to obtain an adequate spin performance.

The hardness (Shore D) of the outer site in the inner core, which is located near the interface between the inner core and the outer layer, is set to 46–62 because, if the hardness (Shore D) is less than 46, it is not possible to accumulate a high energy, while, if the hardness (Shore D) is greater than 62, the feeling of the ball will be adversely affected.

The first embodiment (type 1) shown in FIG. 2 of the present invention has the following specification:

Inner core

Diameter (mm): 23–35
Specific gravity: 1.15–1.5
Hardness (Shore D): 30–62

Outer layer

Diameter (mm): 36–41
Specific gravity: 1.0–1.2
Hardness (Shore D): 30–56

The outer site in the inner core

Hardness (Shore D): 46–62

The solid three-piece ball of this type provides a superior carry distance even if the cover (3*a*) is made of hard resin since the outer layer (2*a*) is soft and the specific gravity of the inner core is greater than that of the outer layer, which provides an adequate spin performance, when the ball is struck by club, allowing an optimum trajectory and a superior carry distance of the ball. This type of golf ball especially provides a keen back spin when the ball is struck by a short iron.

Figure 3:
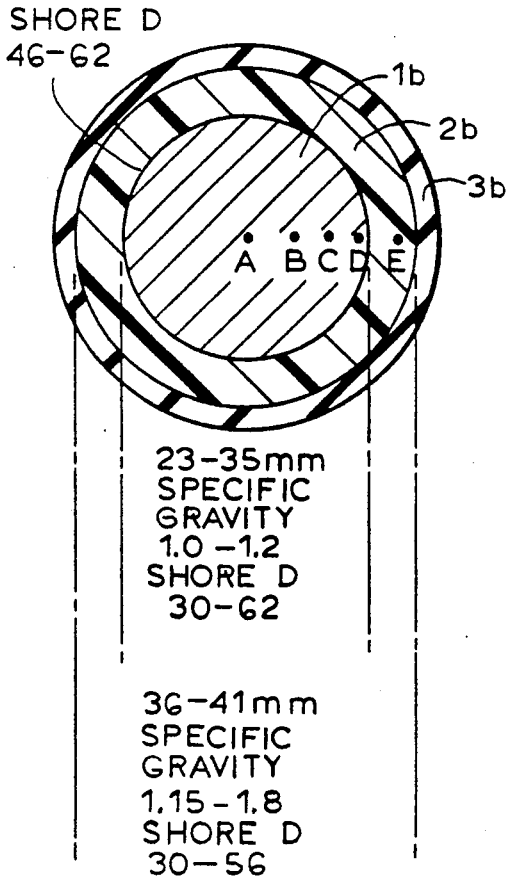
FIG. 3 is a sectional view of a second embodiment (type 2) of the golf ball according to the present invention.

The second embodiment of the present invention as shown in FIG. 3 has the following specification.

Inner core

Diameter (mm): 23–35
Specific gravity: 1.0–1.2
Hardness (Shore D): 30–62

Outer layer

Diameter (mm): 36–41
Specific gravity: 1.15–1.8
Hardness (Shore D): 30–56

The outer site in the inner core

Hardness (Shore D): 46–62

Generally, the carry distance is decreased if the specific gravity of the outer layer is greater than that of the inner core. However, the solid three-piece ball having the above specification provides a superior carry distance since the outer layer (2*b*) is soft and an adequate spin performance allows an optimum trajectory to be formed, although the cover (3*b*) is made of hard resin. This type of golf ball especially provides a trajectory which is less affected by the wind.

Each of the above two types of solid three-piece golf ball has its own characteristics, and a golfer may choose any type of golf ball depending on the peculiarity of his swing, such as, e.g., club head speed, ability of producing spin, and angle of launching the ball.

The inner core and the outer layer comprises a rubber base, co-cross linking agent, filler, polymerization initiator, antioxidant and the like. As a base rubber, Cis-1, 4 polybutadiene alone may be used. If necessary, natural rubber, isoprene rubber, and/or styrene-butadiene rubber may be optionally added to 1, 4-polybutadiene.

The co-cross linking agent comprises a compound selected from $\alpha,\beta$-ethylenically unsaturated carboxylic acids and metal salts thereof. Trimethylol propane trimethacrylate may be optionally added. Examples of $\alpha,\beta$-ethylenically unsaturated carboxylic acids are acrylic acid and methacrylic acid. Metal sats thereof include zinc diacrylate, zinc dimethacrylate, and the like.

The amount of co-cross linking agent used in the inner core is 35–50 parts (weight) for 100 parts (weight) of the base rubber, while the amount of co-cross linking agent used in the outer layer is 25–40 parts (weight).

Fillers which can be used include metal oxides, such as, lead oxide, iron oxide as well as barium sulfate, silica, calcium carbonate and the like. If acrylic acid or methacrylic acid is used, the preferred filler is zinc oxide. The amount of the filler is not limited although it usually depends on the specific gravity or hardness of the inner core or the outer layer to be prepared. The preferred amount of the filler is 1–50 parts (weight) and of the base rubber is 100 parts (weight).

The polymerization initiator includes an organic peroxide, such as, dicumyl peroxide, N-butyl-4, 4'-bis (t-butylperoxy) valerate, bis (t-butylperoxy isopropyl) benzene, 1-1'-bis (t-butylperoxy)-3, 3, 5-trimethyl cyclohexane. The amount of the initiator is 0.2–3.0 parts (weight) of the base rubber is 100 (weight).

If necessary, a coagent such as N-N'-m'-phenelene dimaleimide and the like may be optionally used.

An antioxidizing agent, such as, 2-2'-methylene-bis (4-methyl-6-t-butylphenol) and the like may be added. The amount is preferably 0.5–1.5 parts (weight) of 100 parts (weight) of the base rubber.

The process for preparing the inner core comprises mixing the above components by a conventional mixing apparatus, such as an internal mixer, two roll mill or the like and then subjecting the composition to compression or injection molding.

The compression or injection molding is an important step in the above process, in which the cross linking reaction by the co-cross linking agent takes place with the aid of the initiator under a given temperature and time so as to give the desired hardness distribution in the inner core.

The hardness distribution to be obtained is influenced by the co-cross linking agents and initiators as well as by the temperature and time used for curing.

For each co-cross linking agent, there is an initiator suitable for that co-cross linking agent. The amount of the cross linking agent may be minimized without adversely affecting the hardness distribution when the cross linking reaction is carried out at the reaction temperature, which is 10°–50° C. higher than the decomposition temperature of the initiator used.

If the cross linking reaction takes place at a temperature lower than the above, the distribution of hardness suitable for the present invention cannot be obtained, while, at a temperature higher than the above, a uniform distribution of hardness cannot be obtained.

If the cross linking agent is highly volatile, an initiator with a relatively low decomposition temperature may preferably be used. While the co-cross linking agent is not highly volatile, an initiator having a higher decomposition temperature may preferably be used.

If the cross linking reaction takes place at a higher temperature, the rubber molecules are broken resulting in remarkable degradation of physical properties of the rubber, such as, the resilience and durability of the rubber, due to severe micro Brown motion and nascent oxygen. Therefore, it is necessary to carry out the cross linking reaction with the aid of an initiator having a decomposition temperature which is 0°-50° C. lower than the boiling point of the co-cross linking agent, $\alpha,\beta$-ethylenically unsaturated carboxylic acid.

When an initiator having a relatively low decomposition temperature is used, it is necessary to carry out the cross linking reaction at the temperature which is 20°-50° C. higher than the decomposition temperature for a relatively long time, such as, 10-40 minutes so as to obtain an optimum hardness distribution without adversely affecting other physical properties.

On the other hand, if the initiator with a relatively high decomposition temperature is employed, it is necessary to carry out the cross linking reaction at a temperature which is 10°-40° C. higher than the decomposition temperature for a relatively short period of time, such as, 5-25 minutes.

According to the present invention, the cross linking takes place and the curing of the rubber proceeds when the starting mixture is subjected to heat and pressure predetermined depending on the initiator used. When the heat is transferred through the mixture and rubber is expanded, the co-cross linking agent used is partially evaporated near the metal oxides or salts and the co-cross linking agent in gaseous form migrates from the inner part of the inner core (1) towards the outer part of the inner core carrying out the cross linking reaction of the rubber with the aid of the initiator. Therefore, the cross linking reaction is more active near the outer region of the inner core (1) than at the centre region of the inner core (1) thus resulting in a higher hardness near the outer surface than at the inner region of the core (1).

When the starting mixture is expanded by heating, the mold will be opened unless the mold is prevented from being opened by adding pressure.

Acrylic acid or methacrylic acid form a high molecular weight polymer in the form of matrix having a metal nucleus. The uniformity of cis bonding or cross linking depends on the uniformity of the starting mixture and the heat transfer.

Even after the cross linking is completed, the mixture is continuously expanded by heat until the whole process is completed. It has been found that, due to the pressure added to prevent the opening of the mold, the most dense layers are formed in the region, which is near to the cavity of the mold, namely, the outmost region of the inner core, thus resulting in a gradual increase of the hardness from the centre of the inner core towards the outer part of the inner core forming a maximum hardness site near the interface.

The molecular chains in the most dense layers of the high molecular product are compressed like springs due to the pressure caused by the expansion of the mixture. Therefore, it is possible to store a higher energy.

The outer layer (2) can be prepared by a process similar to that for the inner core (1), although the compression molding as described in the Example is preferred. However, it is important to prevent the outer surface of the outer layer from being too hard so as to obtain the desired hardness distribution as required in the present invention.

However, it is preferred that the crosslinking of the two-piece solid core assembly is carried out at a lower temperature than that for the crosslinking of the inner core to obtain the desired hardness distribution for the present invention.

The starting mixture for preparing the outer layer as well as the solid inner core is also expanded when it is subjected to heating. The expansion in the outer layer is greater than that in the inner core thus resulting in the most dense molecular chains being formed near the interface region between the inner surface of the outer layer and surface of the inner core.

Furthermore, a part of the cross linking agent included in the starting mixture for the outer layer evaporates and the gaseous components formed penetrate into the surface of the inner core rendering a strong binding of the outer layer with the inner core.

The resulting core assembly, which consists of the outer layer and the inner core, has such a hardness distribution that the peak of hardness appears at the outer site in the inner core, which is near the interface between the inner core and the outer layer and that the hardness is gradually decreased toward both sides.

When the ball is struck, it is presumed that the energy given by the club face is efficiently delivered and stored at the site where the hardness is the highest. Then, the energy stored is released toward the inside of the inner core without loss thus resulting in a high rebound coefficient.

The core assembly has a diameter of 36-41 mm and a hardness (Shore D) of 30-62. As mentioned earlier, two types of core assembly are available.

The core assembly is then covered with a resin having a good impact and weather resistance of 0.9-2.6 mm in thickness. The resin may contain inorganic filler, pigment and etc.

As a cover material, balata rubber or ionomer resin (such as "Surlyn" resin marketed by Du Pont Co.) or polyurethane or the like is used, although the ionomer resins are preferred.

The covering is carried out by an injection or compression molding. Finally, the cover is painted to obtain the solid three-piece ball according to the present invention.

As described above, according to the present invention, it is possible to obtain a solid three-piece golf ball of the type (1) or (2) having excellent rebound characteristics and carry distance as well as a high spin performance by adjusting the size and specific gravity as well as the hardness of each of the two pieces forming the core assembly.

The solid three-piece golf ball of the type (1) or (2) according to the present invention provides an excellent carry distance and a better control of the ball compared with a ball having a long roll distance since the golf ball according to the present invention will be least influenced by the ground condition of the field. The golf ball according to the present invention also has an adequate spin performance.

Furthermore, it is possible to control the trajectory of the golf ball of type (1) or (2) using the different moment of inertia of each ball. Therefore, a golfer may select a suitable ball depending on his swing characteristics, such as, his club head speed, spinning ability and launching angle.

EXAMPLE 1

A starting mixture was prepared, which contained Cis-1, 4 polybutadiene rubber (base rubber), zinc diacrylate (co-cross linking agent), zinc oxide (filler), dicumyl peroxide (initiator), 2,2'-methylene-bis (4-methyl-6-t-butyl phenol) (antioxidant) in the amounts as indicated in the Table 1.

The mixture was mixed and kneaded by using a two roll mill for 30 minutes and pressure-molded at 165° C. for 10 minutes to prepare a solid inner core.

The inner core was covered by hemispherical premold outer layers in a mold and the resultant product was cured by heating at 150° C. for 20 minutes to obtain a two-piece solid core assembly. This core assembly was then covered by ionomer resin with same dimple design by injection molding and then painted to provide a solid three-piece golf ball according to the present invention.

A solid two-piece golf ball was also prepared exactly in same way as the above.

24 of each type of golf ball were prepared which include the two types of solid three-piece golf ball (1, 2 in the Table 1) and the solid two-piece golf ball (3 in the Table 1). The golf balls were tested by a swing robot at a U.S. testing organization on the same day. The results of the tests are tabulated in the Table 1.

The test club used was 9.5° Driver Steel S. Shaft made by Taylor Made Golf Co. and the head speed was 108 miles/hour. The trajectory was measured through a wire screen within one inch square increments. The range was 0 to 10. The number was recorded at the point which the ball reached its apex. These numbers are for reference only to other balls in the test.

EXAMPLE 2

The starting mixture was prepared, which contained Cis-1, 4 polybutadiene rubber (rubber), zinc diacrylate (co-cross linking agent), zinc oxide (filler), dicumyl peroxide, N-butyl-4,4'-bis (t-butylperoxy) valerate (initiator), 2,2'-methylene-bis (4-methyl-6-t-butyl phenol) (antioxidant) in the amounts as indicated in the Table 2.

Solid three-piece balls were prepared with the process of the Example 1.

The solid three-piece balls (two types) according to the present invention were prepared and tested (1 and 2 in Table 2).

For comparison tests, three-piece solid golf balls commercially available (3 in Table 2) and thread wound balls (4 in Table 2) were also tested. 24 balls for each type of golf balls were used and tested under same method and conditions on the same day. The results of the tests are tabulated in Table 2.

From the Tables 1 and 2, it has been clearly proved that the solid three-piece golf ball according to the present invention has an excellent rebound characteristics, carry distance and an adequate spin performance.

TABLE 1

| | | Example | | Comparative Example |
|---|---|---|---|---|
| | | 1 | 2 | 3 |
| Starting mixture | Composition of inner core (parts by weight) | | | |
| | Cis-1,4 polybutadiene rubber | 100 | 100 | 100 |
| | zinc diacrylate | 43 | 43 | 40 |
| | zinc oxide | 24.6 | 4.4 | 12.1 |
| | dicumyl peroxide (40%) | 3 | 3 | 3 |
| | 2,2',methylene-bis(4-methyl-6-t-butyl phenol) | 0.5 | 0.5 | 0.5 |
| | Composition of out layer (parts by weight) | | | |
| | Cis-1,4 polybutadiene rubber | 100 | 100 | |
| | zinc diacrylate | 35 | 35 | |
| | zinc oxide | 5.5 | 21.5 | |
| | dicumyl peroxide (40%) | 3 | 3 | |
| | 2,2'-methylene-bis(4-methyl-6-t-butyl phenol) | 0.5 | 0.5 | |
| | Composition of cover (parts by weight) | | | |
| | "Surly 8940" made by Du Pont | 100 | 100 | 100 |
| | Titanium dioxide | 3.1 | 3.1 | 3.1 |
| Physical Properties | Inner Core | | | |
| | Diameter (mm) | 29.7 | 29.7 | |
| | Weight (gr) | 16.5 | 15 | |
| | Specific gravity | 1.20 | 1.09 | |
| | Outer Core | | | |
| | Outer diameter (mm) | 38.7 | 38.7 | 38.7 |
| | Weight of core assembly (gr) | 35.3 | 35.6 | 35.3 |
| | Cover | | | |
| | Diameter of finished ball (mm) | 42.7 | 42.7 | 42.7 |
| | Weight of finished ball (gr) | 45.3 | 45.5 | 45.3 |
| | Distribution of hardness (Shore D) | | | |
| | Center | 42 | 42 | 38 |
| | Site 5 mm apart from center | 53 | 50 | 47 |
| | Site 10 mm apart from center | 54 | 52 | 49 |
| | Site 14 mm apart from center | 61 | 58 | 49 |
| | Site 15 mm apart from center | 56 | 55 | 49 |
| | Site 16 mm apart from center | 55 | 54 | 55 |
| | Site 18 mm apart from center | 55 | 54 | 60 |
| | | 126 | 122 | 122 |
| Characteristics | Carry distance (yds) | 242.80 | 243.23 | 239.19 |
| | Total distance (yds) | 271.61 | 269.38 | 267.47 |
| | Velocity (ft/sec) | 235.76 | 234.78 | 234.48 |
| | Trajectory | 5.54 | 5.52 | 5.29 |
| | | Example | | Comparative Example |

TABLE 1-continued

| | | 1 | 2 | 3 | 4 |
|---|---|---|---|---|---|
| Starting mixture | Composition of inner core (parts by weight) | | | | |
| | Cis-1,4 polybutadiene rubber | 100 | 100 | | |
| | zinc diacrylate | 38 | 40 | | |
| | zinc oxide | 34.2 | 6 | | |
| | dicumyl peroxide (40%) | 3 | 3 | | |
| | 2,2'-methylene-bis(4-methyl-6-t-butyl phenol) | 0.5 | 0.5 | | |
| | Composition of out layer (parts by weight) | | | | |
| | Cis-1,4 polybutadiene rubber | 100 | 100 | | |
| | zinc diacrylate | 32 | 29 | | |
| | zinc oxide | 3 | 24.4 | | |
| | N-butyl-4,4'-bis(t-butylperoxy)valerate(40%) | 3.5 | 3.5 | | |
| | 2,2'-methylene-bis(4-methyl-6-t-butyl phenol) | 0.5 | 0.5 | | |
| | Composition of cover (parts by weight) | | | | |
| | "Surly 8940" made by Du Pont | 100 | 100 | | |
| | Titanium dioxide | 3.1 | 3.1 | | |
| Physical Properties | Inner Core | | | | |
| | Diameter (mm) | 29.7 | 29.7 | | |
| | Weight (gr) | 17.1 | 15.2 | | |
| | Specific gravity | 1.25 | 1.11 | | |
| | Outer Core | | | | |
| | Outer diameter (mm) | 38.7 | 38.7 | 38.3 | |
| | Weight of core assembly (gr) | 35.3 | 35.4 | 34.7 | |
| | Cover | | | | |
| | Diameter of finished ball (mm) | 42.7 | 42.7 | 42.8 | 42.7 |
| | Weight of finished ball (gr) | 45.3 | 45.3 | 45.0 | 45.5 |
| | Distribution of hardness (Shore D) | | | | |
| | Center | 38 | 39 | | |
| | Site 5 mm apart from center | 45 | 46 | | |
| | Site 10 mm apart from center | 45 | 47 | | |
| | Site 14 mm apart from center | 52 | 53 | | |
| | Site 15 mm apart from center | 45 | 39 | | |
| | Site 16 mm apart from center | 44 | 38 | | |
| | Site 18 mm apart from center | 44 | 38 | | |
| | | 108 | 104 | 122 | 90 |
| Characteristics | Carry distance (yds) | 223.12 | 223.87 | 213.20 | 221.79 |
| | Total distance (yds) | 253.04 | 256.12 | 248.00 | 251.83 |
| | Velocity (ft/sec) | 235.67 | 235.46 | 233.41 | 231.23 |
| | Trajectory | 5.26 | 5.28 | 4.80 | 5.12 |

We claim:

1. A solid three-piece golf ball comprising a core assembly provided by an inner core 1 and an outer layer 2 and a cover 3 characterized by the following features:

a) the inner core 1 has a diameter in the range 23–35 mm and hardness (Shore D) in the range 30–62;

b) the outer layer 2 has a diameter in the range 36–41 mm and hardness (Shore D) in the range 30–56;

c) the golf ball has a maximum hardness (Shore D) in the range of 46–62 at the outer site of the inner core which is located at the interface between the inner core 1 and the outer layer 2 of the golf ball and the hardness then decreases both inwardly and outwardly.

2. A solid three-piece golf ball according to claim 1, in which the specific gravities of the inner core 1 and the outer layer 2 are in the ranges 1.15–1.50 and 1.00–1.20, respectively.

3. A solid three-piece golf ball according to claim 1, in which the specific gravities of the inner core 1 and the outer layer 2 are in the ranges 1.00–1.20 and 1.15–1.80, respectively.

4. A solid three-piece golf ball according to any one of claims 1–3, in which the site of maximum hardness is located 11.5–17.5 mm from the center of the ball.

5. A solid three-piece ball according to any one of claims 1–3 in which the minimum hardness (Shore D) difference between the said outer site in the inner core 1 and the site in the outer layer 2 of the ball is 3.

* * * * *

US005184828A

REEXAMINATION CERTIFICATE (2619th)

United States Patent [19]

[11] B1 5,184,828

Kim et al.

[45] Certificate Issued Jul. 4, 1995

[54] SOLID THREE-PIECE GOLF BALL

[75] Inventors: Moon K. Kim; In H. Hwang, both of Seoul, Rep. of Korea

[73] Assignee: Ilya Co., Ltd., Seoul, Rep. of Korea

Reexamination Request:
No. 90/003,509, Jul. 27, 1994

Reexamination Certificate for:

| | |
|---|---|
| Patent No.: | **5,184,828** |
| Issued: | **Feb. 9, 1993** |
| Appl. No.: | **699,933** |
| Filed: | **May 14, 1991** |

[30] Foreign Application Priority Data

Jun. 1, 1990 [KR] Rep. of Korea ..... 90-8095

[51] Int. Cl.[6] ..... A63B 37/06
[52] U.S. Cl. ..... 273/228; 273/230
[58] Field of Search ..... 273/62, 218, 219, 220, 273/225, 228, 229, 230

[56] References Cited

U.S. PATENT DOCUMENTS

| | | | |
|---|---|---|---|
| 4,570,937 | 2/1986 | Yamada | 273/220 |
| 4,650,193 | 3/1987 | Molitor et al. | 273/230 X |
| 4,714,253 | 12/1987 | Nakahara et al. | 273/230 X |
| 4,781,383 | 11/1988 | Kamata et al. | 273/230 X |
| 4,848,770 | 7/1989 | Shama | 273/228 |
| 5,002,281 | 3/1991 | Nakahara et al. | 273/230 X |
| 5,048,838 | 9/1991 | Chikaraishi | 273/230 X |

FOREIGN PATENT DOCUMENTS 63-61029 11/1988 Japan .

OTHER PUBLICATIONS

JIS-K-6301, 1969.

*Primary Examiner*—George J. Marlo

[57] ABSTRACT

A non-wound three-piece golf ball which comprises an inner core, an outer layer and a cover, the inner core having a diameter of 23–35 mm and a hardness (Shore D) of 30–62, the outer layer having a diameter of 36–41 mm and a hardness (Shore D) of 30–56, the golf ball having a hardness (Shore D) 46–62 at the outer site in the inner core, which is 11.5–17.5 mm apart from the center of the ball. The golf ball has a maximum hardness (Shore D) in the range of 46–62 at the outer site of the inner core which is located at the interface between the inner core 1 and the outer layer 2 of the golf ball and the hardness then decreases both inwardly and outwardly.

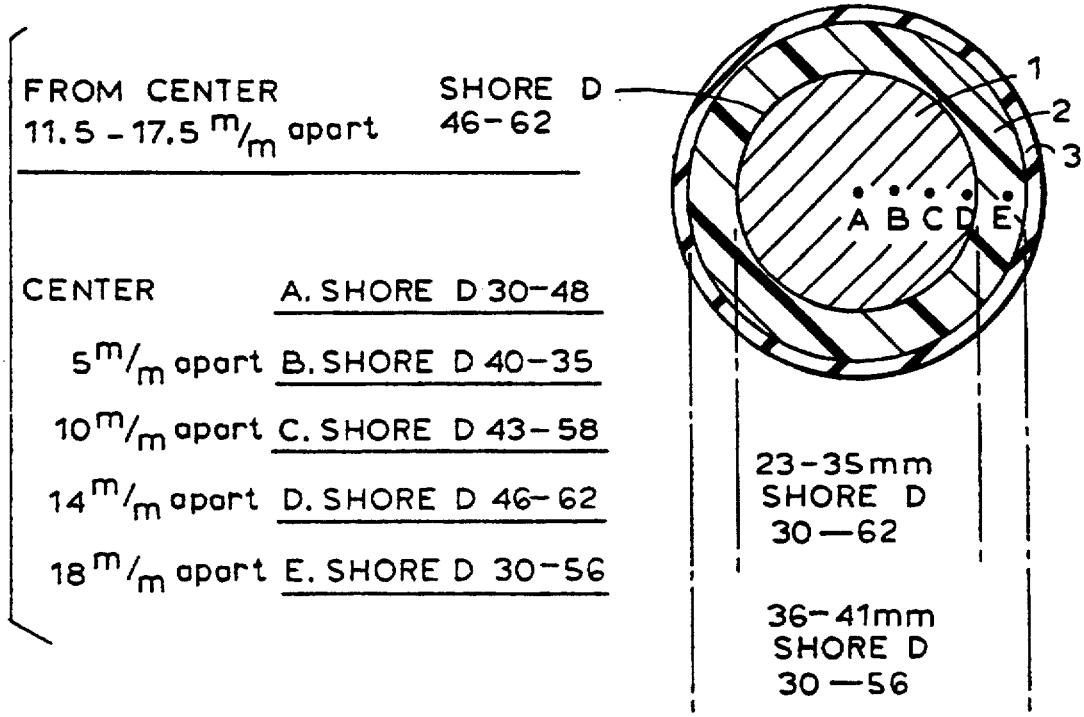

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-5 is confirmed.

* * * * *